US012702255B2

(12) United States Patent
Chen

(10) Patent No.: US 12,702,255 B2
(45) Date of Patent: Aug. 11, 2026

(54) FOLDABLE BATH SUPPORT AND USE METHOD THEREOF

(71) Applicant: Xiao Chen, Zhejiang (CN)

(72) Inventor: Xiao Chen, Zhejiang (CN)

( * ) Notice: Subject to any disclaimer, the term of this patent is extended or adjusted under 35 U.S.C. 154(b) by 172 days.

(21) Appl. No.: 18/674,703

(22) Filed: May 24, 2024

(65) Prior Publication Data

US 2025/0359710 A1 Nov. 27, 2025

(51) Int. Cl.
*A47K 3/12* (2006.01)

(52) U.S. Cl.
CPC ..... *A47K 3/122* (2013.01)

(58) Field of Classification Search
CPC ..... A47K 3/064; A47K 3/062; A47K 3/06; A47K 3/07; A47K 3/074; A47K 3/127
See application file for complete search history.

(56) References Cited

U.S. PATENT DOCUMENTS 243,573 A * 6/1881 Jones ..... A47K 3/064 4/587
860,577 A * 7/1907 Scherrer ..... A47K 3/064 4/587
11,122,938 B2 * 9/2021 Mutch ..... A47K 3/064
11,395,564 B1 * 7/2022 Matias ..... A47K 3/064
11,937,745 B2 * 3/2024 Yang ..... A47K 3/06
11,944,243 B2 * 4/2024 Chen ..... A47K 3/024
12,178,367 B1 * 12/2024 Chen ..... A47K 3/064
12,290,215 B1 * 5/2025 Chen ..... A47K 3/064
12,310,540 B1 * 5/2025 Chen ..... A47K 3/064
12,390,054 B1 * 8/2025 Chen ..... A47K 3/127
12,426,744 B1 * 9/2025 Zhang ..... A47K 3/06
12,433,452 B1 * 10/2025 Zhang ..... A47K 3/06
12,465,179 B1 * 11/2025 Chen ..... A47K 3/064
2022/0079390 A1 * 3/2022 Pruzhansky ..... A47K 3/024

* cited by examiner

*Primary Examiner* — Erin Deery

(74) *Attorney, Agent, or Firm* — Hawaii Patent Services; Nathaniel K. Fedde; Kenton N. Fedde

(57) ABSTRACT

A foldable bath support comprises a bath support body and a foot stool detachably connected to one end of the bath support body, wherein the bath support body comprises a first support body, a second support body and a folding component connecting the first support body and the second support body, and the first support body and the second support body are unfolded or folded through the folding component.

16 Claims, 11 Drawing Sheets

FOLDABLE BATH SUPPORT AND USE METHOD THEREOF

TECHNICAL FIELD

The present application relates to the technical field of baby products, in particular to a foldable bath support and a using method thereof.

BACKGROUND

The existing bath support design often ignores the importance of portability and space utilization. This kind of bath support is usually unable to be folded, which leads to its huge size and fixation, so it is particularly inconvenient to transport and store. During transportation, because the bath supports can't be folded and shrunk, they will occupy a lot of space, which not only increases the difficulty of loading transport vehicles, but also may lead to a significant increase in transportation costs.

At the same time, for home users, the bath support still occupies a certain storage space when not in use, which undoubtedly brings challenges to the cleanliness and effective use of the home environment. In order to solve these problems, we urgently need to develop a foldable bath support, so as to save space and reduce transportation costs during transportation and storage, and at the same time, it is convenient for home users to store and use.

For example, the bath supports disclosed in U.S. Patent No. 2023/0320534 and U.S. patent Ser. No. 11/627,842 have the above problems. The bath supports cannot be folded, which takes up a lot of space during transportation and storage, and the transportation cost is high.

In view of the above, it is necessary to put forward a new type of bath support, which occupies small space, has low transportation cost and is more convenient to use.

SUMMARY

The present application provides a foldable bath support, which includes a bath support body and a foot stool detachably connected to one end of the bath support body, wherein the bath support body comprises a first support body, a second support body and a folding component connecting the first support body and the second support body, and the first support body and the second support body are unfolded or folded through the folding component; and the folding component comprises a first folding part arranged on the first support body, a second folding part arranged on the second support body, and a locking member; a first limiting hole is arranged in the first folding part, and a first clamping block is formed in the first limiting hole; a second limiting hole corresponding to the first limiting hole is arranged in the second folding part, and a second clamping block is formed in the second limiting hole in a direction close to the first clamping block; the locking member is arranged in the first limiting hole and the second limiting hole in a penetrating way, and rotationally connects the first folding part and the second folding part; and wherein, when the first folding part and the second folding part rotate relatively until the first support body and the second support body are unfolded, the second clamping block abuts against the first clamping block and locks the first support body and the second support body.

The present invention further provides a method for using a foldable bath support, comprising providing a bathtub and the foldable bath support, wherein the foldable bath support comprises a bath support body and a foot stool detachably connected to one end of the bath support body, wherein the bath support body comprises a first support body, a second support body and a folding component connecting the first support body and the second support body, and the first support body and the second support body are unfolded or folded through the folding component; and the folding component comprises a first folding part arranged on the first support body, a second folding part arranged on the second support body, and a locking member; a first limiting hole is arranged in the first folding part, and a first clamping block is formed in the first limiting hole; a second limiting hole corresponding to the first limiting hole is arranged in the second folding part, and a second clamping block is formed in the second limiting hole in a direction close to the first clamping block; the locking member is arranged in the first limiting hole and the second limiting hole in a penetrating way, and rotationally connects the first folding part and the second folding part; and wherein, when the first folding part and the second folding part rotate relatively until the first support body and the second support body are unfolded, the second clamping block abuts against the first clamping block and locks the first support body and the second support body;

the method comprises the following steps:

unfolding the first support body and the second support body through the folding component; and assembling the foot stool to a lower part of the bath support body; and placing the foldable bath support in the bathtub and taking a bath.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

In the figures.

Figure 1:
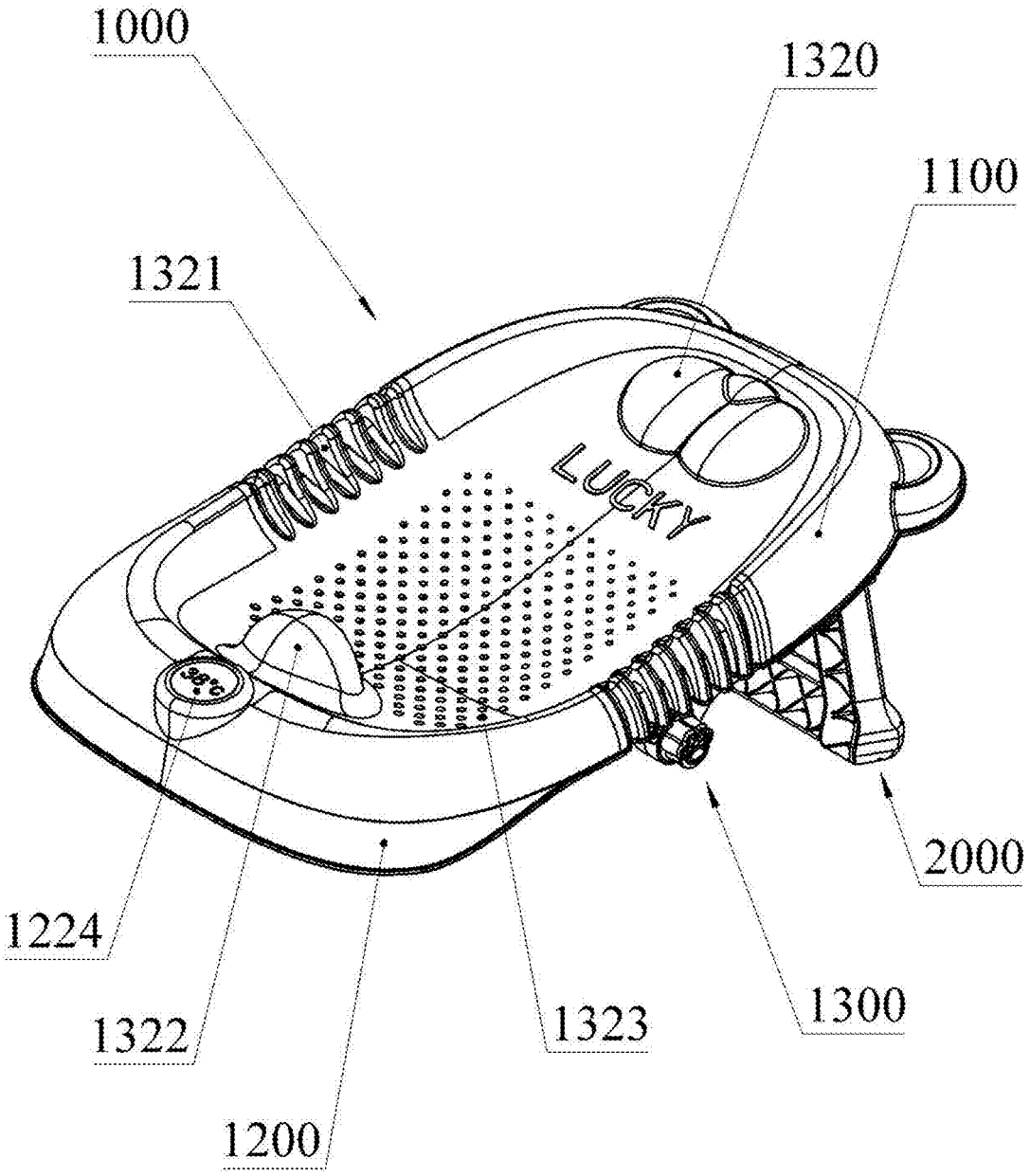
FIG. 1 is a schematic view of a foldable bath support.

Bath support body (1000)
First support body (1100)
First folding part (1110
First limiting hole (1111)
First blocking block (1112)
First embedded block (1113)
First embedding groove (1114)
First fixing hole (1115
Second fixing hole (1116)
First clamping ring (1117)
First accommodating part (1118)
First inscribed ring (1119)
First snap protrusion (1120)
Locking block (1121)
Second slope (1122)
First tooth part (1123)
First abutting end (1124)
Installation slot (1125)
Rotating shaft hole (1126)
Positioning hole (1127)
Second support body (1200)
Second folding part (1210)
Second limiting hole (1211)
Second clamping block (1212)
Second embedded block (1213)
Second embedding groove (1214)
Third fixing hole (1215)
Fourth fixing hole (1216)
Second clamping ring (1217)
Second accommodating part (1218)
Second snap protrusion (1219)
Second inscribed ring (1220)
Fixed snap ring (1221)
Second tooth part (1222)
Second abutting part (1223)
Thermometer (1224)
Folding component (1300)
Locking member (1310)
Fixing protrusion (1311)
Locking projection (1312)
First slope (1313)
Seat part (1320)
Corrugated part (1321)
Seat protrusion (1322)
Leakage hole (1323)
Foot stool (2000)
Rotating shaft part (2100)
Positioning part (2200).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

As shown in FIGS. 1 to 11, the present application provides a foldable bath support, which includes a bath support body 1000 and a foot stool 2000 detachably connected to one end of the bath support body 1000. The bath support body 1000 includes a first support body 1100 and a second support body 1200, and a folding component 1300 connecting the first support body 1100 and the second support body 1200.

The folding component 1300 includes a first folding part 1110 arranged on the first support body 1100, a second folding part 1210 arranged on the second support body 1200, and a locking member 1310, wherein the first folding part 1110 is provided with a first limiting hole 1111, a first blocking block 1112 is formed in the first limiting hole 1111, and the second folding part 1210 is provided with a second limiting hole 1211 corresponding to the first limiting hole 1111. In the second limiting hole 1211, a second clamping block 1212 is formed in the direction close to the first blocking block 1112, and the locking member 1310 penetrates through the first limiting hole 1111 and the second limiting hole 1211 to rotationally connect the first folding part 1110 and the second folding part 1210.

When the first folding part 1110 and the second folding part 1210 rotate relatively until the first support body 1100 and the second support body 1200 are unfolded, the second clamping block 1212 abuts against the first blocking block 1112 and locks the first support body 1100 and the second support body 1200.

This embodiment provides a foldable bath support, which is convenient to carry, and can be stably supported when in use, so as to meet various needs of users when bathing.

In this embodiment, the foldable bath support mainly includes a bath support body and a foot stool. The bath support body is further composed of a first support body, a second support body and a folding component connecting them. This design enables the bath support body to be unfolded and folded conveniently, thus adapting to different use environments and storage requirements.

In this embodiment, the first support body is provided with a first folding part, and the second support body is provided with a second folding part. These two parts are rotationally connected through the locking member, which realizes the folding and unfolding functions of the bath support body. At the same time, in order to ensure the stability in the unfolded state, a first limiting hole is set in the first folding part, and a first blocking block is formed therein. Correspondingly, a second limiting hole corresponding to the first limiting hole is arranged in the second folding part, and a second blocking block is formed therein in the direction close to the first blocking block. When the first folding part and the second folding part rotate relatively until the bath support body is fully unfolded, the second blocking block will abut against the first blocking block, thus effectively locking the first support body and the second support body and ensuring the stability of the bath support when in use.

The foldable bath support has the advantages of compact structure, small volume after folding and convenient carrying and storage. At the same time, the unfolded bath support body has a stable structure, can bear a certain weight, and meets the needs of users for placing toiletries and supporting their bodies. In addition, due to the detachable foot stool design, users can choose whether to install the foot stool according to actual needs, which further increases the flexibility and applicability of the bath support.

As shown in FIG. 1, in this embodiment, the first support body 1100 and the second support body 1200 are provided with flexible seat part 1320, which are deformed with the unfolding or folding of the first support body 1100 and the second support body 1200, wherein the seat part 1320 are provided with corrugated parts 1321, which are arranged on the folding component 1300 and are deformed with the unfolding or folding of the first support body 1100 and the second support body 1200.

Specifically, the foldable bath support is provided with flexible seats on the first support body and the second support body. This design enables users to have a comfortable and stable seat when bathing, which greatly improves the convenience and comfort of bathing. When the body of the bath support is in a folded state, the seat can deform with it, keeping its flexibility and foldability, without affecting the overall carrying and storage of the bath support. When the body of the bath support is unfolded, the seat part is restored to its original state, providing a flat and stable sitting surface for users.

In this embodiment, the seat is also provided with corrugated parts, which are skillfully arranged on the folding component. This design enables the seat to better adapt to the deformation of the first support body and the second support body in the process of folding and unfolding, and maintain the stability of its shape and function. At the same time, the existence of the corrugated part also increases the elasticity and durability of the seat, so that it can bear more use pressure and wear, and prolong the service life of the bath support.

The advantage of this improved foldable bath support is that it not only inherits the advantages of traditional foldable bath support which is easy to carry and store, but also innovates in user experience. By arranging the flexible seat part and the corrugated part, the bath support can provide stable support and bring more comfortable and convenient bathing experience to users. Whether at home, traveling or other occasions where temporary bathing is needed, this improved foldable bath support can bring great convenience and comfort to users.

As shown in FIG. 1, in this embodiment, a thermometer 1224 is provided on the second support body 1200.

Specifically, the setting of the thermometer enables the user to know the water temperature information conveniently when taking a bath. By observing and reading the data on the thermometer, users can accurately judge whether the temperature of bath water is appropriate, thus avoiding discomfort or safety hazards caused by too high or too low water temperature.

In addition, the design of the thermometer also takes into account the convenience of users. It is skillfully installed on the second support body, which will not occupy too much space and will not affect the overall aesthetics of the bath support body. At the same time, the reading mode of the thermometer is simple and clear, and users can easily obtain the required information without additional operation or adjustment.

The benefits brought by this improved foldable bath support are manifold. First of all, it improves the safety of bathing. By accurately grasping the water temperature information, users can avoid scalding or catching a cold caused by improper water temperature and ensure their own health and safety. Secondly, it improves the comfort of bathing. Users can adjust the temperature of bath water according to their own preferences and needs, and enjoy a more comfortable and cozy bathing experience. Finally, it also enhances the practicality and functionality of the bath support. The existence of the thermometer makes the bath support not only a simple bathing tool, but also an intelligent device that can provide all-round services and meet various needs of users.

In other embodiments (not shown in the figure), a special hook is arranged on one side or the top of the bath support for hanging the shower head. In this way, it is convenient for users to adjust the position and height of the nozzle when bathing, making bathing more flexible and comfortable; a storage basket is added below or on the side of the bath support to store bath products, such as shampoo, shower gel, soap, etc., and this can keep the bathing space clean and tidy, and make it convenient for users to take what they need at any time; massage cushion or massage points are added to the seat to provide the function of relieving muscle fatigue, and users can enjoy the comfort brought by massage when bathing, and further relax their body and mind; anti-skid pads are arranged at the bottom of the seat and the foot stool to increase the friction with the ground, prevent the bath support from sliding or toppling during use, and ensure the safety of users; an integrated intelligent control system, such as Bluetooth connection, voice control, etc., enables users to control the functions of the bath support through mobile phones or other intelligent devices, such as water temperature adjustment, nozzle switch, etc., to improve the convenience and intelligent level of use.

Figure 2:
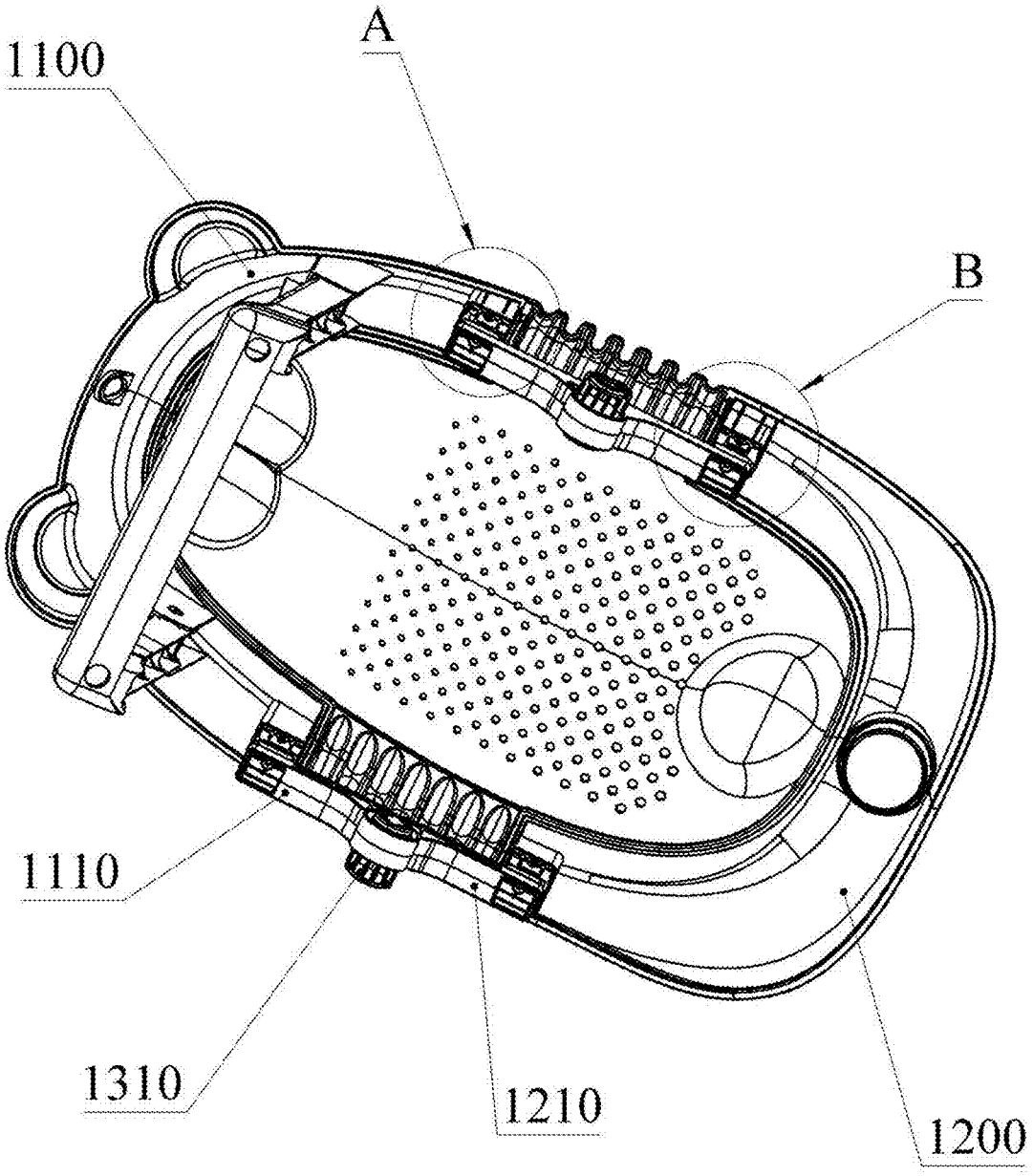
FIG. 2 is another schematic view of the foldable bath support.
Figure 3:
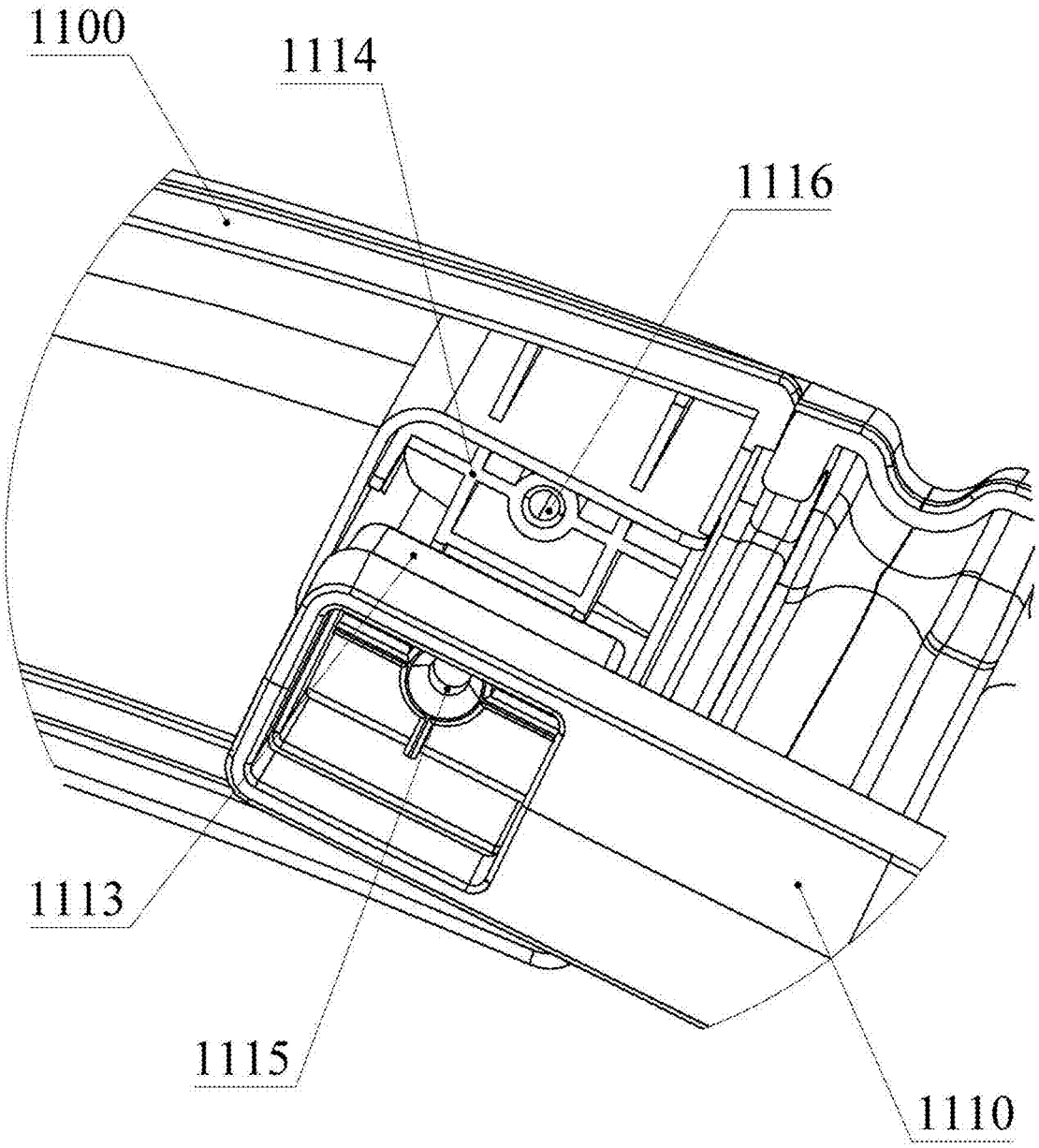
FIG. 3 is an enlarged schematic view at A in FIG. 2.

As shown in FIGS. 2 to 3, in this embodiment, a first embedded block 1113 is formed on the first folding part 1110, and at least one first embedding groove 1114 is formed at the lower end of the first support body 1100. The first embedding groove 1114 is configured to have shape corresponding to the first embedded block 1113; a first fixing hole 1115 is formed in the first embedded block 1113, and a second fixing hole 1116 is formed in the first embedding groove 1114, wherein the first folding part 1110 and the first support body 1100 are fixedly connected through the first embedded block 1113, the first embedding groove 1114 and the first fixing member.

Specifically, the first embedded block is formed on the first folding part, which makes the first folding part more complete in structure and provides convenience for subsequent connection with the first support body. At the lower end of the first support body, at least one first embedding groove is set, and the shapes of these embedding grooves are matched with the first embedded blocks to ensure that they can be closely embedded together.

In order to further enhance the stability of the connection, a first fixing hole is formed in the first embedded block, and a second fixing hole is formed in the corresponding first embedding groove. The arrangement of these two fixing holes makes it possible to firmly connect the first folding part and the first support body through the first fixing member (such as screws, pins, etc.). This connection mode is not only simple in structure, but also reliable in connection effect, which can effectively prevent the bath support from loosening or deforming during use.

The benefits brought by this improved foldable bath support are manifold. First of all, through the embedded design of the first embedded block and the first embedding groove, the structure of the bath support is more stable and can bear greater weight and impact force, thus prolonging the service life of the bath support. Secondly, this connection mode is convenient for disassembling and assembling, and users can easily disassemble or reassemble the bath support according to their needs, which is convenient for carrying and storage. In addition, due to the embedded design, the appearance of the bath support is more neat and beautiful, which meets the aesthetic needs of modern home.

In this embodiment, the first folding part and the first support body are fixedly connected through the first embedded block, the first embedding groove and the first fixing member. In other embodiments (not shown in the figure), the first folding part and the first support body are not limited to being fixedly connected by the first embedded block, the first embedding groove and the first fixing member, but also can be arranged as snap connection, welding, riveting and any other desired connection mode.

Figure 4:
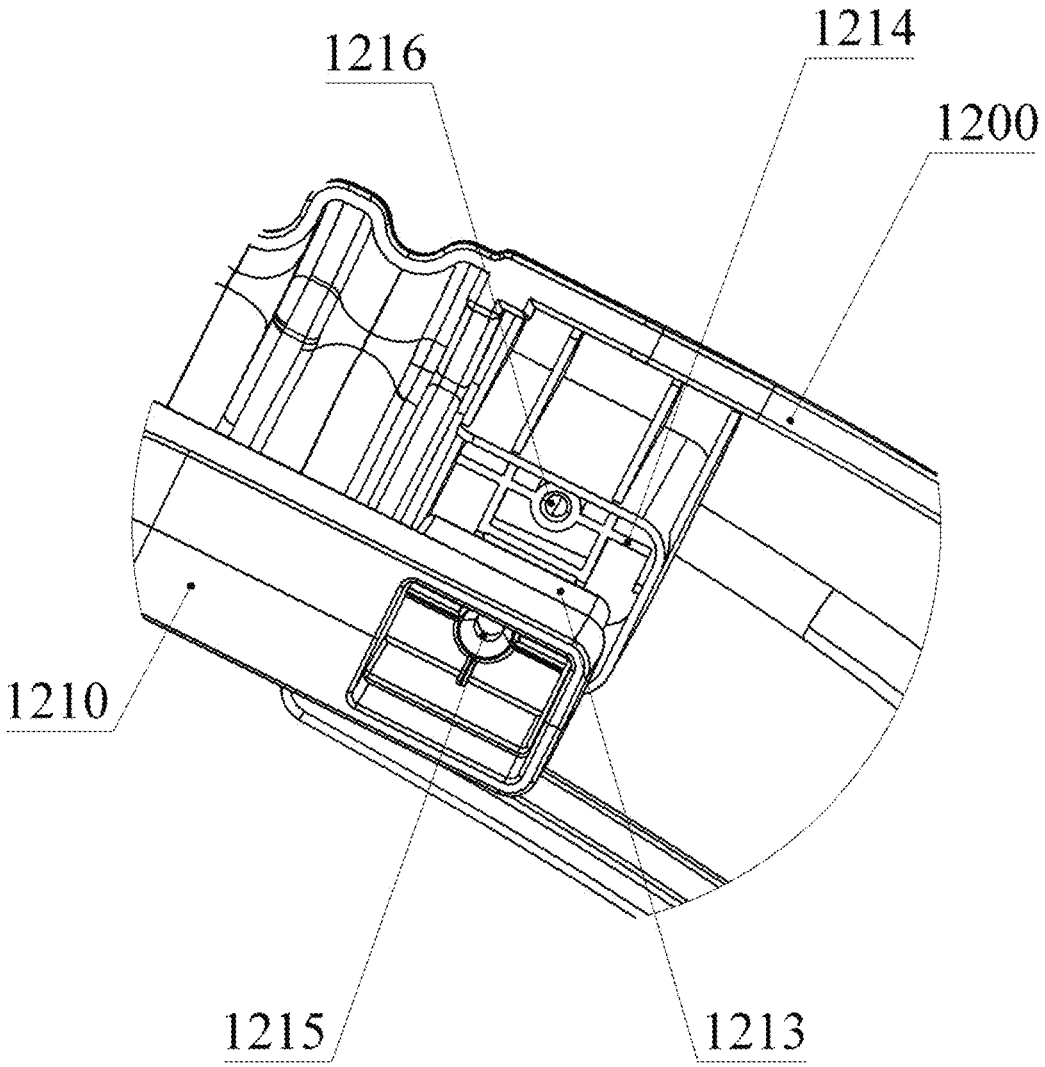
FIG. 4 is an enlarged schematic view at B in FIG. 2.
Figure 5:
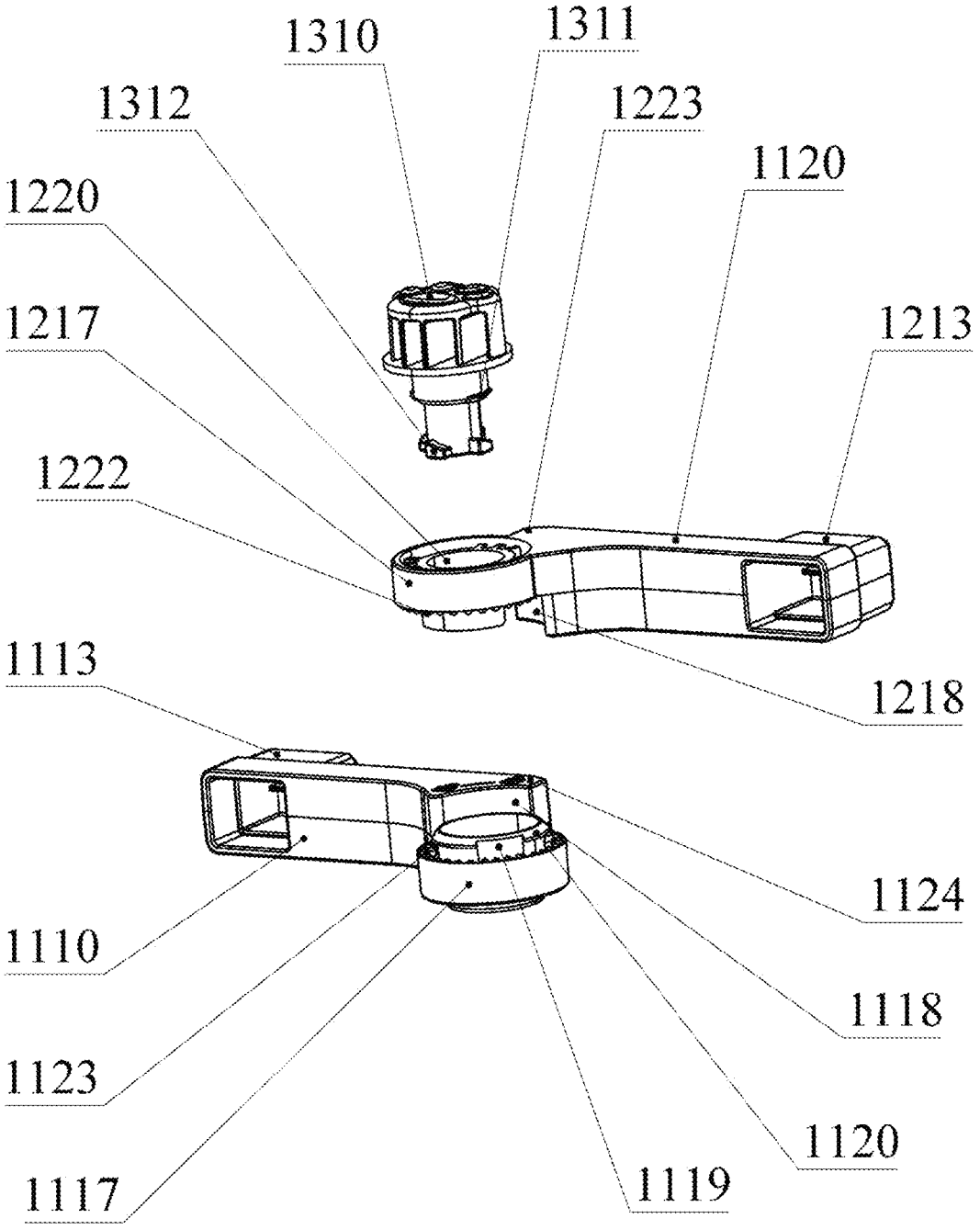
FIG. 5 is a schematic view of the folding component.
Figure 6:
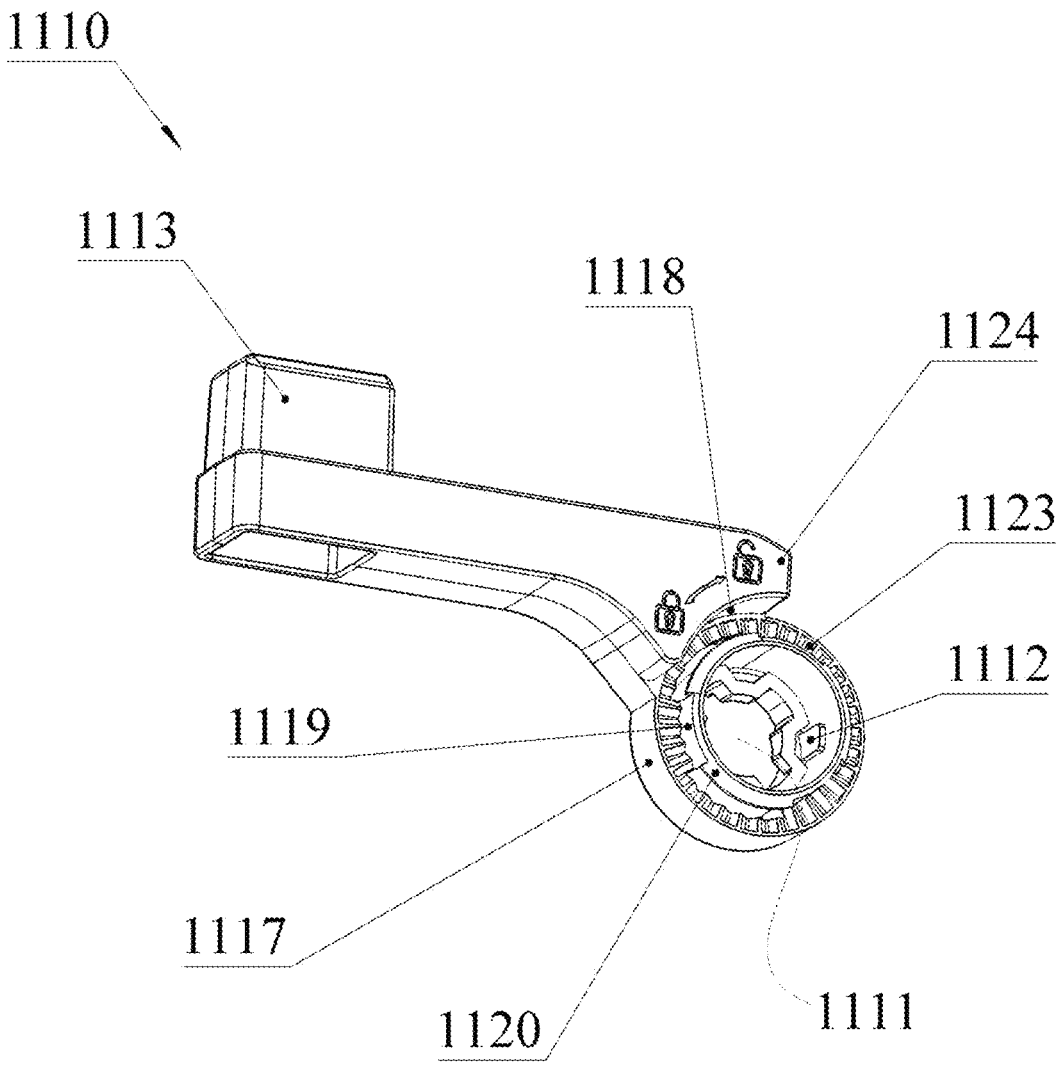
FIG. 6 is a schematic view of the first folding part.
Figure 7:
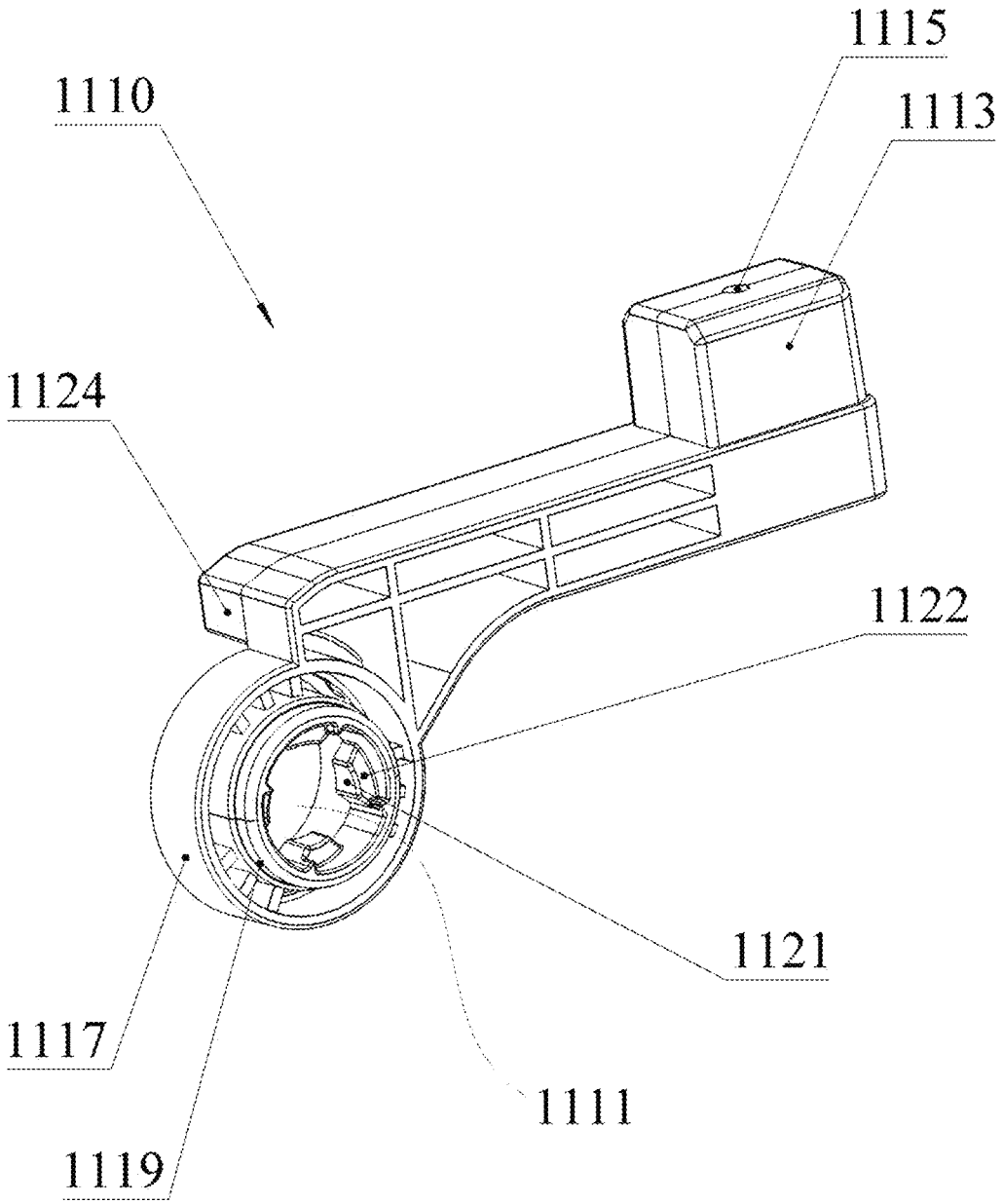
FIG. 7 is another schematic view of FIG. 6.
Figure 8:
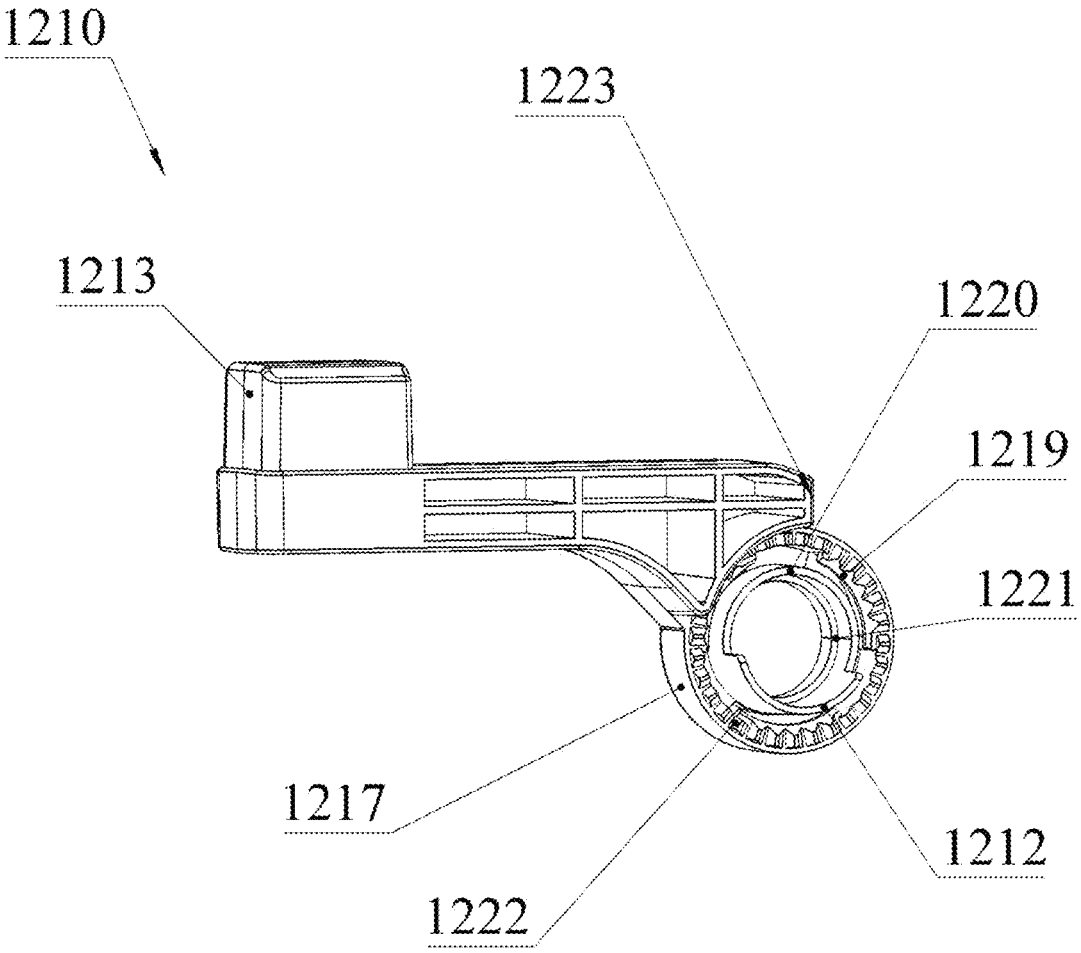
FIG. 8 is a schematic view of the second folding part.
Figure 9:
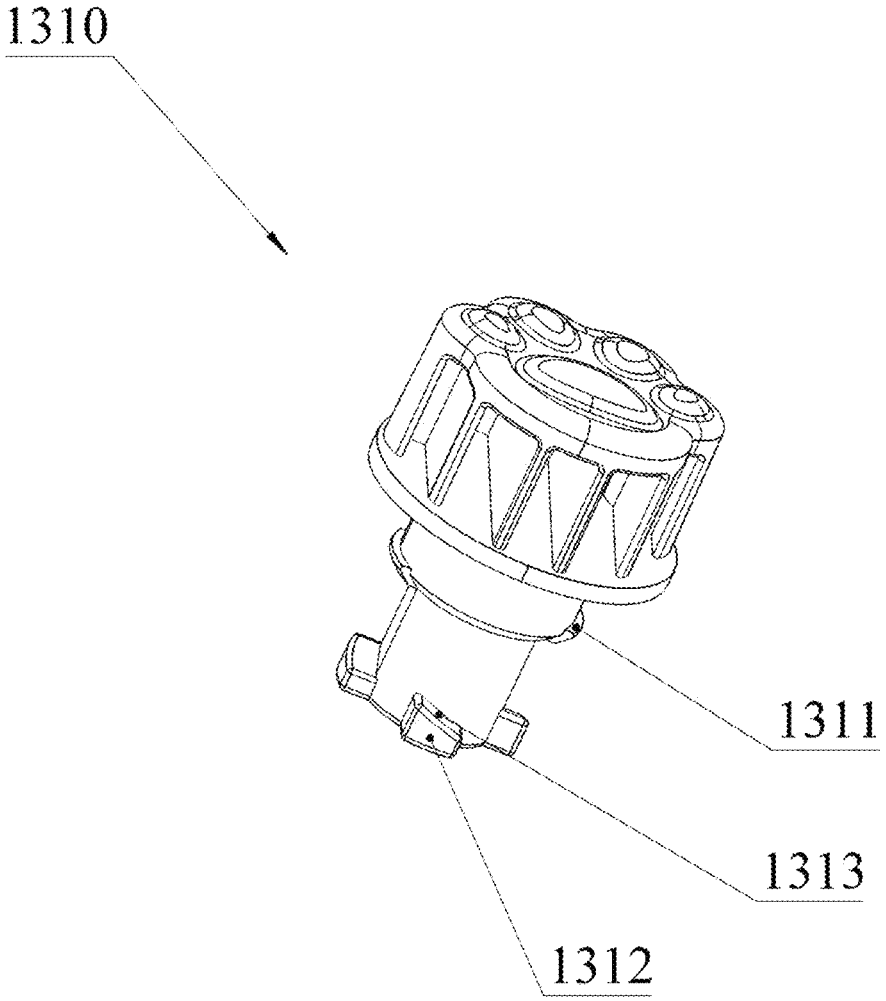
FIG. 9 is a schematic view of the locking member.

As shown in FIGS. 2 to 4, in this embodiment, a second embedded block 1213 is formed on the second folding part 1210, and at least one second embedding groove 1214 is formed at the lower end of the second support body 1200; the second embedding groove 1214 is configured to have a shape corresponding to the second embedded block 1213; a third fixing hole 1215 is formed in the second embedded block 1213, and a fourth fixing hole 1216 is formed in the second embedding groove 1214, wherein the second folding part 1210 and the support body 1200 are fixedly connected through the second embedded block 1213, the second embedding groove 1214 and the second fixing member.

Specifically, the second embedded block is formed on the second folding part, which makes the second folding part more stable in structure and provides effective support for the connection with the second support body. At the same time, at the lower end of the second support body, we set at least one second embedding groove, and the shapes of these embedding grooves are precisely matched with the second embedded blocks to ensure that they can be closely embedded together to form a stable connection structure.

In order to further enhance the stability of the connection, we designed a third fixing hole in the second embedded block, and formed a fourth fixing hole in the corresponding second embedding groove. The arrangement of these two fixing holes enables us to firmly connect the second folding part and the second support body through the second fixing members (such as screws and pins). This connection mode is not only simple and effective, but also reliable in connection effect, which can ensure that the bath support will not be loose or deformed during use.

This improved foldable bath support has brought many benefits. First of all, through the embedded design of the second embedded block and the second embedding groove, the structure of the bath support is more stable and can bear greater weight and impact force, thus prolonging the service life of the bath support. Secondly, this connection greatly simplifies the disassembling and assembling process of the bath support, and users can easily disassemble or reassemble the bath support according to their needs, which is convenient for carrying and storage. In addition, due to the embedding design, the appearance of the bath support is more neat and beautiful, which meets the aesthetic needs of modern home.

In this embodiment, the second folding part and the second support body are fixedly connected through the second embedded block, the second embedding groove and the second fixing member. In other embodiments (not shown in the figure), the first folding part and the first support body are not limited to being fixedly connected by the first embedded block, the first embedding groove and the first fixing member, but also can be arranged as snap connection, welding, riveting and any other desired connection mode.

As shown in FIGS. 5 to 8, in this embodiment, a first clamping ring 1117 and a first accommodating part 1118 are formed on the first folding part 1110, the first accommodating part 1118 is configured to accommodate the second clamping ring 1217; the second clamping ring 1217 and the second accommodating part 1218 are formed on the second folding part 1210, and the second accommodating part 1218 is configured to accommodate the first clamping ring 1117, wherein, the second clamping ring 1217 is arranged in the first accommodating part 1118, and the first clamping ring 1117 is arranged in the second accommodating part 1218.

Specifically, a first clamping ring and a first accommodating part are formed on the first folding part. As a fixed structure, the first clamping ring provides a stable support point for the connection. The first accommodating part is configured to accommodate the second clamping ring, and this design enables the second folding part to be closely embedded into it to form a stable connection.

At the same time, a second clamping ring and a second accommodating part are formed on the second folding part. The second clamping ring corresponds to the first clamping ring, and the tight connection between the first folding part and the second folding part is realized through the cooperation of the two. And the second accommodating part is configured to accommodate the first clamping ring, so that the first folding part can be smoothly embedded into it, further enhancing the stability of the connection.

In practical application, the second clamping ring is arranged in the first accommodating part, and the first clamping ring is arranged in the second accommodating part. This configuration makes the foldable bath support stable during unfolding and folding, and it is not easy to be loose or misplaced. At the same time, the combination of the clamping ring and the accommodating part has certain elasticity, which can adapt to the adjustment of different angles and strengths, so that users can feel a smoother and more comfortable use experience during operation.

As shown in FIGS. 5 to 8, in this embodiment, a first inscribed ring 1119 is formed on the first clamping ring 1117 in the direction close to the second clamping ring 1217, and the first inscribed ring 1119 is configured to allow access to the second clamping ring 1217; a first snap projection 1120 is formed on the first inscribed ring 1119, and a second snap protrusion 1219 is provided in the second clamping ring 1217; wherein, the first clamping ring 1117 and the second clamping ring 1217 are movably connected by the first inscribed ring 1119, the first snap protrusion 1120 and the second snap protrusion 1219.

Specifically, in the direction of the first clamping ring approaching the second clamping ring, a first inscribed ring is skillfully designed. This inscribed ring is configured to allow access to the inside of the second clamping ring to form a compact embedded structure. With this design, the first clamping ring and the second clamping ring can be attached together more closely when connected, and the overall stability is enhanced.

In order to further enhance the firmness of the connection, the first snap protrusion is formed on the first inscribed ring. These snap protrusions have certain elasticity and toughness, and can be firmly embedded into the second clamping ring to form an effective snap connection. At the same time, the second clamping ring is also provided with a corresponding second snap protrusion, which cooperates with the first snap protrusion to form a stable movable connection structure.

The first clamping ring and the second clamping ring can be connected quickly and firmly through the movable connection mode of combining the inscribed ring with the snap protrusion. The user only needs to simply insert the first inscribed ring into the second clamping ring, and ensure that the first snap protrusion and the second snap protrusion are mutually embedded, so that the connection process can be completed. This connection mode is not only simple and convenient to operate, but also reliable in connection effect, which can effectively prevent the bath support from loosening or falling off during use.

As shown in FIGS. 5 to 8, in this embodiment, a second clamping ring 1217 is inwardly formed with a second inscribed ring 1220, which is configured to allow access to the first inscribed ring 1119; the inscribed ring is formed with a second clamping block 1212 in the direction close to the first inscribed ring 1119, and a first blocking block 1112 is formed in the first inscribed ring 1119, wherein at least part of the first blocking block 1112 is allowed to abut against the second clamping block 1212.

Specifically, a second inscribed ring is formed inwardly on the second clamping ring, which makes the second clamping ring more complete in structure and provides the possibility for close cooperation with the first inscribed ring. The second inscribed ring is configured to allow the access to the first inscribed ring, and this nested structure enables the first and second clamping rings to form a more compact and stable structure when connected.

In order to further enhance the stability of the connection, a second clamping block is formed in the direction of the second inscribed ring close to the first inscribed ring. The design of these clamping blocks has a certain geometric shape and size, which can effectively cooperate with the first clamping block in the first inscribed ring. At the same time, a corresponding first clamping block is also formed in the first inscribed ring, and these clamping blocks are at least partially allowed to abut against the second clamping blocks.

In actual uses, when the second clamping ring is connected with the first clamping ring, the second inscribed ring will enter the first inscribed ring, and at the same time, the second clamping block will abut against the first clamping block. This abutting mechanism not only increases the stability of the connection, but also prevents the bath support from being accidentally loosened or deformed during use.

As shown in FIGS. 5 to 8, in this embodiment, a first limiting hole 1111 is provided in a first inscribed ring 1119, and a second limiting hole 1211 is provided in a second inscribed ring 1220, and a locking member 1310 passes through the second limiting hole 1211 and the first limiting hole 1111 in turn, wherein the first folding part 1110 and the second folding part 1210 are rotationally connected through the locking member 1310.

Specifically, the first limiting hole is set in the first inscribed ring, which enables the locking member to accurately pass through and be fixed at this position, providing a stable foundation for the subsequent rotation connection. At the same time, the second inscribed ring is also provided with a corresponding second limiting hole, which corresponds to the first limiting holes in position and jointly provides a path for the locking member to pass through.

In practical application, the locking member is designed to pass through the second limiting hole and the first limiting hole in turn. This step is simple and direct, and the user only needs to align the locking member with the limiting hole and gently push it in to complete the installation. In this way, a close rotational connection is formed between the first folding part and the second folding part. This connection is not only stable and reliable, but also allows them to rotate freely within a certain range, thus realizing the folding and unfolding functions of the bath support.

As shown in FIGS. 5 to 9, in this embodiment, at least one fixing protrusion 1311 and a locking projection 1312 are formed on the locking member 1310, and a fixing clamping ring 1221 is formed in the second inscribed ring 1220, the fixing clamping ring 1221 corresponds to the fixing protrusion 1311, wherein the locking member 1310 and the second folding part 1210 form a snap connection; and at least one locking block 1121 is formed in the first inscribed ring 1119, and the locking block 1121 corresponds to the locking projection 1312, and a first slope 1313 is formed on the locking projection 1312, and a second slope 1122 is formed on the locking block 1121, and the second slope 1122 corresponds to the first slope 1313, wherein the locking member 1310, the first folding part 1110 and the second folding part 1210 form a locking.

Specifically, at least one fixing protrusion and a locking protrusion are formed on the locking member. The shapes and sizes of these protrusions are designed to ensure that they can be accurately matched with other parts. The fixing protrusion corresponds to the fixed snap ring in the second inscribed ring, and when the locking member penetrates into the second limiting hole, the fixing protrusion will closely adhere to the fixed snap ring to form a stable fixed connection. This design makes the locking member not easy to loosen or fall off when stressed, and enhances the stability of the bath support body structure.

At the same time, the locking protrusion on the locking member corresponds to the locking block in the first inscribed ring. These locking protrusions and locking blocks are designed with specific shapes and angles to realize the function of a snap connection. A first slope is formed on the locking protrusion, and a corresponding second slope is formed on the locking block. When the locking member is pushed into place, the first slope and the second slope will contact each other and generate a certain friction force, so that the locking member can be firmly fixed in the first inscribed ring. This design not only enhances the stability of the connection, but also makes the operation smoother and more labor-saving.

As shown in FIGS. 5 to 8, in this embodiment, a first tooth part 1123 is provided at one end of the first inscribed ring 1119 near the second inscribed ring 1220, and a second tooth part 1222 is provided at one end of the second inscribed ring 1220 near the first inscribed ring 1119, and the second tooth part 1222 and the first tooth part 1123 are meshed with each other.

Specifically, at the end of the first inscribed ring near the second inscribed ring, the first tooth is set. These teeth parts are arranged according to a certain arrangement and spacing, forming a unique occlusal structure. At the same time, at one end of the second inscribed ring close to the first inscribed ring, a corresponding second tooth part is also set. The shape, size and arrangement of the second teeth are matched with those of the first teeth, so that they can be meshed with each other.

In practical applications, when the first inscribed ring and the second inscribed ring are butted, the first tooth and the second tooth will contact each other and closely occluded. This meshing mechanism enables the first folding part and the second folding part to form a more stable and firm structure when connected. Because of the existence of the tooth parts, even under the action of an external force, the two inscribed rings are not easy to separate or loosen, thus ensuring the overall stability of the bath support.

In addition, the tooth design also improves the convenience and accuracy of operation. Users only need to gently butt the two inscribed rings, and the teeth will automatically mesh without additional adjustment or fixing operation. At the same time, the meshing structure of the tooth parts also has a certain guiding function, which can help the user to complete the docking action more accurately and improve the accuracy and efficiency of the operation.

As shown in FIGS. 5 to 8, in this embodiment, the first folding part 1110 has a first abutting end 1124 and the second folding part 1210 has a second abutting part 1223, wherein the first abutting end 1124 and the second abutting part 1223 abut against each other when the first folding part 1110 and the second folding part 1210 are relatively rotated until the first support body 1100 and the second support body 1200 are unfolded.

Specifically, the first folding part is provided with a first abutting end, and the second folding part is provided with a second abutting part. These two abutting ends and abutting parts are precisely designed and configured to contact each other and generate abutting action under specific operating conditions.

When the user needs to unfold the bath support, the first folding part and the second folding part will be rotated relatively through corresponding operations. With the rotation, the first support body and the second support body are gradually unfolded until the predetermined unfolded state is reached. In this process, the first abutting end and the second abutting part will be close to each other and finally abut.

Figure 10:
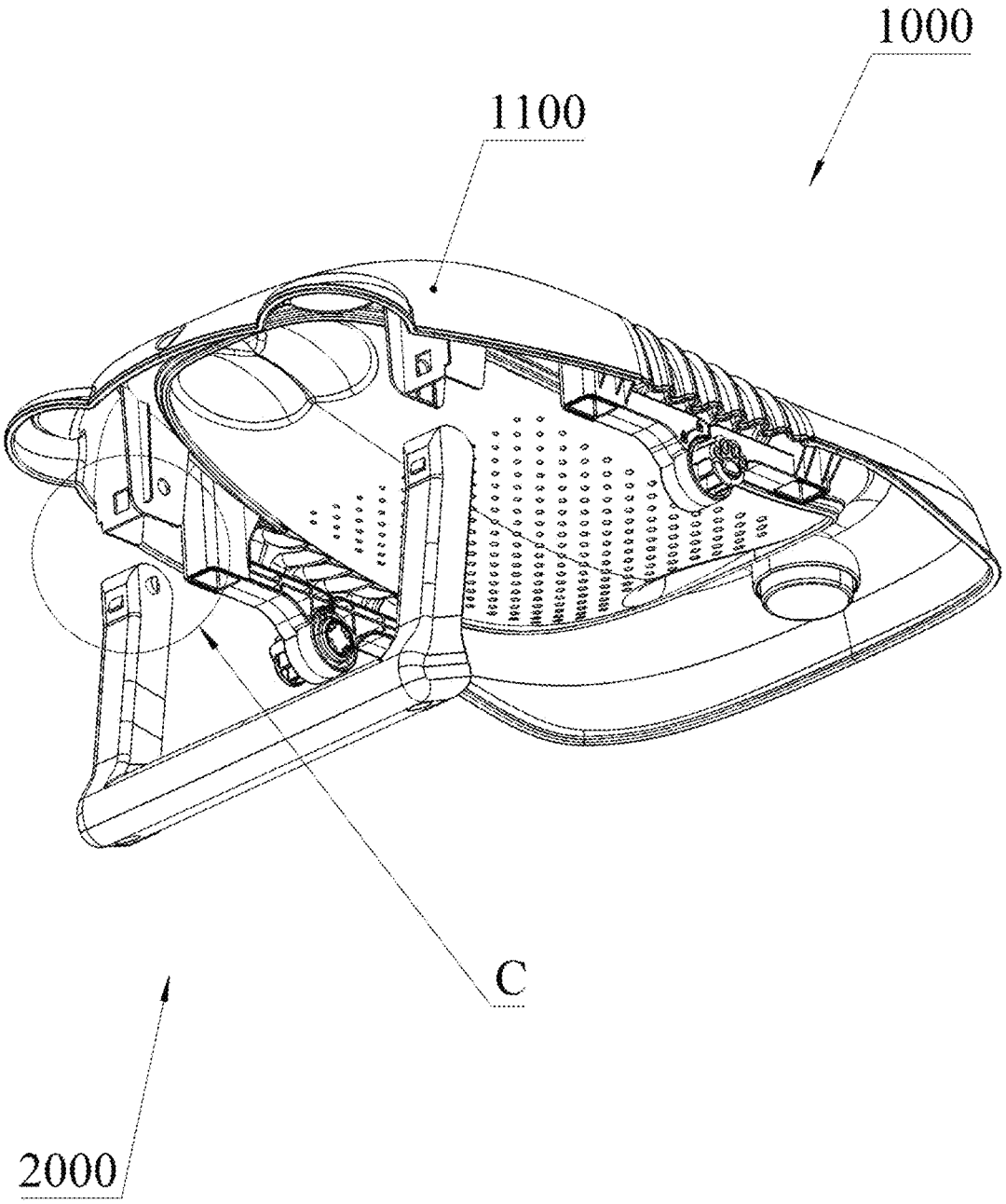
FIG. 10 is a partial exploded view of the foldable bath support.
Figure 11:
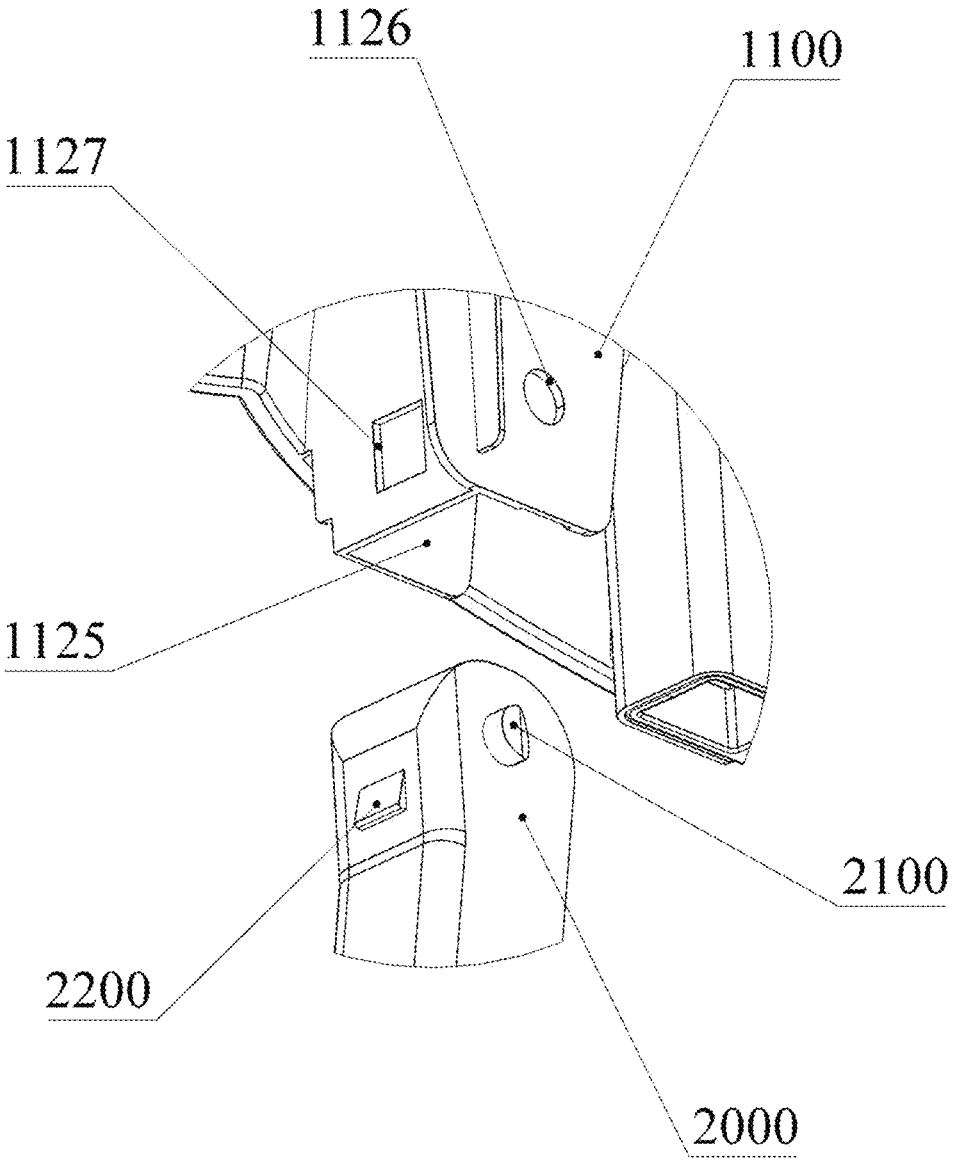
FIG. 11 is a schematic view at C in FIG. 10.

As shown in FIGS. 10 to 11, in this embodiment, the first support body 1100 is provided with at least one installation slot 1125, in which a rotating shaft hole 1126 and a positioning hole 1127 are formed, and a foot stool 2000 is provided with a rotating shaft part 2100 and a positioning part 2200; the foot stool 2000 is at least partially arranged in the installation slot 1125, and the rotating shaft part 2100 is arranged in the positioning hole 1127; the positioning part 2200 is arranged in the positioning hole 1127, wherein the first support body 1100 and the foot stool 2000 are rotatably connected through the rotating shaft hole 1126, the positioning hole 1127, the rotating shaft part 2100 and the positioning part 2200.

In this embodiment, the foot stool is provided as a substantially U-shaped support. In other embodiments (not shown in the figure), the foot stool is not limited to a "U" shape, but also can be set to a square, a triangle, a semicircle and any desired geometric shape.

Specifically, at least one installation slot is arranged on the first support body. A rotating shaft hole and a positioning hole are formed in each installation slot, and the positions and sizes of these two holes are accurately calculated and designed to ensure perfect cooperation with the corresponding parts on the foot stool.

As an important part of the bath support, the foot stool is provided with a rotating shaft part and a positioning part. The shapes, sizes and materials of these components have been strictly selected and tested to ensure that they can work stably in the installation slot. When the foot stool is installed on the first support body, at least part of it will be arranged in the installation slot. At this time, the rotating shaft part of the foot stool will be accurately arranged in the rotating shaft hole of the installation slot, and the positioning part will be arranged in the positioning hole.

Through this design, a rotary connection is formed between the first support body and the foot stool. This connection mode is not only firm and reliable, but also can bear large weight and impact force, and at the same time allows the first support body and the foot stool to rotate relatively within a certain range. This rotation function enables the bath support to be easily folded and unfolded, thus adapting to different use requirements.

As shown in FIG. 1, in this embodiment, the seat part 1320 is provided with a seat protrusion 1322 and a plurality of leakage holes 1323.

Specifically, the seat protrusion and a plurality of leakage holes are arranged on the seat part, which not only improves the user experience, but also enhances the practicality and comfort of the bath support. The design of the seat protrusion on the seat fully considers the ergonomic principle. The seat protrusion can provide better support and fit for the user, so that the user can feel more stable and comfortable support when sitting down. This design can not only reduce the discomfort when using the bath support for a long time, but also improve the user's bathing experience.

Secondly, a plurality of leakage holes arranged on the seat reflect practicality. The existence of leakage holes enables the bath support to effectively drain water during use, which avoids the risk of slipping caused by accumulated water and is convenient for users to clean the bath support after use. This design not only improves the safety of the bath support, but also reduces the maintenance burden of users.

In addition, the combination design of the seat protrusion and the leakage holes also enhances the overall aesthetics of the bath support. After careful design, the shape and lines of the seat bulge echo each other with the layout of the leakage hole, forming a harmonious and unified visual effect.

The present application also provides a use method of the foldable bath support, which includes the following steps: providing a bathtub and the foldable bath support, wherein the foldable bath support comprises a bath support body and a foot stool detachably connected to one end of the bath support body, wherein the bath support body comprises a first support body, a second support body and a folding component connecting the first support body and the second support body, and the first support body and the second support body are unfolded or folded through the folding component; and the folding component comprises a first folding part arranged on the first support body, a second folding part arranged on the second support body, and a locking member; a first limiting hole is arranged in the first folding part, and a first clamping block is formed in the first limiting hole; a second limiting hole corresponding to the first limiting hole is arranged in the second folding part, and a second clamping block is formed in the second limiting hole in a direction close to the first clamping block; the locking member is arranged in the first limiting hole and the second limiting hole in a penetrating way, and rotationally connects the first folding part and the second folding part; and wherein, when the first folding part and the second folding part rotate relatively until the first support body and the second support body are unfolded, the second clamping block abuts against the first clamping block and locks the first support body and the second support body;

the method comprises the following steps:

unfolding the first support body and the second support body through the folding component; and assembling the foot stool to a lower part of the bath support body; and placing the foldable bath support in the bathtub and taking a bath.

Further, the bathtub and the foldable bath support with matching sizes need to be selected.

Further, the first support body and the second support body are provided with flexible seats, and the seats are deformed with the unfolding or folding of the first support body and the second support body, wherein the seats are provided with corrugated parts, and the corrugated parts are configured on the folding component; and the foldable bath support is unfolded and locked, so that the seat parts allow a person to sit on, and when taking a bath, the person sits on the seat parts.

The foldable bath support provided by the present application has many use scenarios, including but not limited to the following scenarios:

In the family bathroom environment, the bath support, as an auxiliary bathing equipment, provides users with a convenient, comfortable and safe bathing experience. The design of the seat protrusion enables family members, especially the elderly and children, to get better support when taking a bath, and reduces the accident risk caused by slipping or instability. At the same time, the arrangement of a plurality of leakage holes ensures that the accumulated water in the bathing process can be discharged in time, which keeps the bath support dry and clean, and further improves the comfort and safety of use.

In public bathing places, such as gymnasiums, swimming pools and the like, the use scenes of the bath support are equally extensive. Due to the large flow of people in public bathing places, the durability and safety of bathing equipment are required to be higher. The stable structure and innovative design of the above-mentioned bath support enable it to adapt to high-frequency use while maintaining good use effect. In addition, the design of the seat protrusion and leakage hole also takes into account public health issues, which is convenient for users to clean and disinfect after use and ensure the health and safety of the next user.

To sum up, the above-mentioned bath support is suitable for various use scenarios such as family bathroom environment and public bathing places, and its innovative design and excellent performance can meet the needs of different users, providing a comfortable and safe bathing experience.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

What is claimed is:

1. A foldable bath support, comprising:

a bath support body and a foot stool detachably connected to one end of the bath support body, wherein the bath support body comprises a first support body, a second support body and a folding component connecting the first support body and the second support body, and the first support body and the second support body are unfolded or folded through the folding component; and the folding component comprises a first folding part arranged on the first support body, a second folding part arranged on the second support body, and a locking member; a first limiting hole is arranged in the first folding part, and a first clamping block is formed in the first limiting hole; a second limiting hole corresponding to the first limiting hole is arranged in the second folding part, and a second clamping block is formed in the second limiting hole in a direction facing the first clamping block; the locking member is arranged in the first limiting hole and the second limiting hole in a penetrating way, and rotationally connects the first folding part and the second folding part; and wherein, when the first folding part and the second folding part rotate relative to one another until the first support body and the second support body are unfolded, the second clamping block abuts against the first clamping block and locks the first support body and the second support body.

2. The foldable bath support according to claim 1, wherein the first support body and the second support body are provided with a flexible seat part, and the flexible seat part is deformed with an unfolding or folding of the first support body and the second support body, wherein the flexible seat part is provided with a corrugated, part and the corrugated part is provided at the folding component.

3. The foldable bath support according to claim 2, wherein a first embedded block is formed on the first folding part, at least one first embedding groove is arranged at a lower end of the first support body, and the at least one first embedding groove is arranged in a shape corresponding to the first embedded block; and a first fixing hole is formed in the first embedded block, and a second fixing hole is formed in the at least one first embedding groove, wherein the first folding part is fixedly connected to the first support body through the first embedded block, the at least one first embedding groove and a first fixing member.

4. The foldable bath support according to claim 3, wherein a second embedded block is formed on the second folding part, at least one second embedding groove is arranged at a lower end of the second support body, and the at least one second embedding groove is arranged in a shape corresponding to the second embedded block; and a third fixing hole is formed in the second embedded block, and a fourth fixing hole is formed in the at least one second embedding groove, wherein the second folding part is fixedly connected to the second support body through the second embedded block, and the at least one second embedding groove and a second fixing member.

5. The foldable bath support according to claim 4, wherein a first clamping ring and a first accommodating part are formed on the first folding part, and the first accommodating part is configured to accommodate a second clamping ring; and a second clamping ring and a second accommodating part are formed on the second folding part, and the second accommodating part is configured to accommodate the first clamping ring, wherein the second clamping ring is arranged in the first accommodating part and the first clamping ring is arranged in the second accommodating part.

6. The foldable bath support according to claim 5, wherein the first clamping ring is formed with a first inscribed ring in a direction facing the second clamping ring, and the first inscribed ring is configured to allow access to the second clamping ring; and a first snap protrusion is formed on the first inscribed ring, and a second snap protrusion is arranged in the second clamping ring, wherein the first clamping ring is movably connected to the second clamping ring through the first inscribed ring, and the first snap protrusion and the second snap protrusion.

7. The foldable bath support according to claim 6, wherein the second clamping ring is inwardly formed with a second inscribed ring, and the second inscribed ring is configured to allow access to the first inscribed ring; and the second inscribed ring is formed with the second clamping block in a direction facing the first inscribed ring, and the first clamping block is formed in the first inscribed ring, wherein at least part of the first clamping block is allowed to abut against the second clamping block.

8. The foldable bath support according to claim 7, wherein the first limiting hole is arranged in the first inscribed ring, and the second limiting hole is arranged in the second inscribed ring; and the locking member sequentially passes through the second limiting hole and the first limiting hole, wherein the first folding part and the second folding part are rotationally connected through the locking member.

9. The foldable bath support according to claim 8, wherein at least one fixing protrusion and a locking protrusion are formed on the locking member, and a fixing clasp is formed in the second inscribed ring, and the fixing clasp corresponds to the at least one fixing protrusion, wherein the locking member and the second folding part form a snap connection; and at least one locking block is formed in the first inscribed ring, and the at least one locking block corresponds to the locking protrusion; and a first slope is formed on the locking protrusion, and a second slope is formed on the at least one locking block; and the second slope corresponds to the first slope, wherein the locking member, the first folding part and the second folding part form a locking.

10. The foldable bath support according to claim 9, wherein a first tooth part is arranged at one end of the first inscribed ring facing the second inscribed ring, and a second tooth part is arranged at one end of the second inscribed ring facing the first inscribed ring, and the second tooth part and the first tooth part are meshed with each other.

11. The foldable bath support according to claim 10, wherein the first folding part has a first abutting end and the second folding part has a second abutting part, and when the first folding part and the second folding part rotate relatively until the first support body and the second support body are unfolded, the first abutting end and the second abutting part abut against each other.

12. The foldable bath support according to claim 11, wherein at least one installation slot is arranged on the first support body, and a rotating shaft hole and a positioning hole are formed in the at least one installation slot; and a rotating shaft part and a positioning part are arranged on the foot stool, and the foot stool is at least partially arranged in the at least one installation slot; and the rotating shaft part is arranged in the rotating shaft hole, and the positioning part is arranged in the positioning hole, wherein the first support body and the foot stool form a rotating connection through the rotating shaft hole, the positioning hole, the rotating shaft part and the positioning part.

13. The foldable bath support according to claim 12, wherein a seat protrusion and a plurality of leakage holes are arranged on the flexible seat part.

14. The foldable bath support according to claim 13, wherein a thermometer is arranged on the second support body.

15. A method for using a foldable bath support, comprising providing a bathtub and the foldable bath support, wherein the foldable bath support comprises a bath support body and a foot stool detachably connected to one end of the bath support body, wherein the bath support body comprises a first support body, a second support body and a folding component connecting the first support body and the second support body, and the first support body and the second support body are unfolded or folded through the folding component; and the folding component comprises a first folding part arranged on the first support body, a second folding part arranged on the second support body, and a locking member; a first limiting hole is arranged in the first folding part, and a first clamping block is formed in the first limiting hole; a second limiting hole corresponding to the first limiting hole is arranged in the second folding part, and a second clamping block is formed in the second limiting hole in a direction facing the first clamping block; the locking member is arranged in the first limiting hole and the second limiting hole, and rotationally connects the first folding part and the second folding part; and wherein, when the first folding part and the second folding part rotate to one another until the first support body and the second support body are unfolded, the second clamping block abuts against the first clamping block and locks the first support body and the second support body;

the method comprises the following steps:

unfolding the first support body and the second support body through the folding component; and assembling the foot stool to a lower part of the bath support body; and placing the foldable bath support in the bathtub and taking a bath.

16. The method for using a foldable bath support according to claim 15, wherein the first support body and the second support body are provided with a flexible seat part, and the flexible seat part is deformed with an unfolding or folding of the first support body and the second support body, wherein the flexible seat part is provided with a corrugated part, and the corrugated part is at the folding component; and the foldable bath support is unfolded and locked, so that the flexible seat part allows a person to sit on, and when taking a bath, the person sits on the flexible seat part.

* * * * *